US010899517B2

(12) United States Patent
Georgas et al.

(10) Patent No.: US 10,899,517 B2
(45) Date of Patent: Jan. 26, 2021

(54) DRINK CONTAINER SANITARY WIPE ATTACHABLE TO A DRINK CONTAINER

(71) Applicants: Taso Georgas, Winchester, TN (US); George Michalopoulos, Joplin, MO (US)

(72) Inventors: Taso Georgas, Winchester, TN (US); George Michalopoulos, Joplin, MO (US)

( * ) Notice: Subject to any disclaimer, the term of this patent is extended or adjusted under 35 U.S.C. 154(b) by 803 days.

(21) Appl. No.: 14/678,215

(22) Filed: Apr. 3, 2015

(65) Prior Publication Data

US 2015/0283589 A1 Oct. 8, 2015

Related U.S. Application Data

(60) Provisional application No. 62/086,856, filed on Dec. 3, 2014, provisional application No. 61/975,724, filed on Apr. 4, 2014.

(51) Int. Cl.

| | |
|---|---|
| ***A47L 13/16*** | (2006.01) |
| ***A47L 13/17*** | (2006.01) |
| ***B08B 1/00*** | (2006.01) |
| ***B65D 65/02*** | (2006.01) |
| ***B65D 23/14*** | (2006.01) |
| ***B65D 25/20*** | (2006.01) |

(52) U.S. Cl.

CPC ..... *B65D 65/02* (2013.01); *A47L 13/16* (2013.01); *A47L 13/17* (2013.01); *B08B 1/006* (2013.01); *B65D 23/14* (2013.01); *B65D 25/205* (2013.01); *Y10S 206/812* (2013.01)

(58) Field of Classification Search

CPC .... A47K 2010/3266; A47K 2010/3273; A47L 13/17; B08B 1/00; B08B 7/00; B65D 65/02; B65D 23/14; B65D 25/205; Y10S 206/812

USPC ..... 15/209.1, 246; 206/581; 220/23.83, 220/23.86

See application file for complete search history.

(56) References Cited

U.S. PATENT DOCUMENTS

| | | | | |
|---|---|---|---|---|
| 4,450,844 A * | 5/1984 | Quisno | A61B 10/0035 600/556 |
| 4,651,890 A * | 3/1987 | Coker | B08B 1/00 215/6 |
| 5,599,550 A * | 2/1997 | Kohlruss | A47L 13/17 15/209.1 |
| 5,607,388 A * | 3/1997 | Ewall | A61F 13/023 602/46 |
| 5,692,616 A | 12/1997 | Baker | |
| 5,961,500 A | 10/1999 | Weinstein | |

(Continued)

*Primary Examiner* — Laura C Guidotti
*Assistant Examiner* — Thomas Raymond Rodgers
(74) *Attorney, Agent, or Firm* — Jefferson IP Law, LLP

(57) ABSTRACT

A sanitary wipe is provided, including a pad that is contained beneath or as part of an adhesive sticker or otherwise attachable body that is releasably secured at any convenient point on a surface of a container or containment vessel, such as the side or top of the containment vessel. The pad can be provided with or without a cleaning substance. For use, the user simply pulls the adhesive sticker or attachable body free of the container, and uses the wipe part or pad of the sticker or body to clean and remove contamination wherever contamination is suspected or at any other desired location, like on the lid of the containment vessel.

18 Claims, 12 Drawing Sheets

(56) References Cited

U.S. PATENT DOCUMENTS

| | | | | |
|---|---|---|---|---|
| 7,240,790 | B2 * | 7/2007 | Wendel | A45D 37/00 206/210 |
| 7,325,675 | B2 | 2/2008 | Halkyard | |
| 7,686,161 | B2 * | 3/2010 | Simmons | B65D 25/24 206/217 |
| 8,147,965 | B2 * | 4/2012 | Shi | A61F 13/15731 428/423.1 |
| 8,490,818 | B2 | 7/2013 | Akers | |
| 9,162,798 | B2 * | 10/2015 | Hands | B65D 25/205 |
| 2002/0043473 | A1 * | 4/2002 | Lee | B65D 51/20 206/217 |
| 2004/0026289 | A1 * | 2/2004 | Halkyard | A61B 1/126 206/494 |
| 2004/0108237 | A1 | 6/2004 | McClintock | |
| 2005/0115856 | A1 | 6/2005 | Halkyard | |
| 2006/0151351 | A1 * | 7/2006 | Hughes | B65D 75/5805 206/494 |
| 2007/0209959 | A1 * | 9/2007 | Burgess | B65D 75/5838 206/494 |
| 2011/0068113 | A1 | 3/2011 | Kim | |
| 2013/0306663 | A1 | 11/2013 | Stuchell et al. | |

* cited by examiner

DRINK CONTAINER SANITARY WIPE ATTACHABLE TO A DRINK CONTAINER

CROSS-REFERENCE TO RELATED APPLICATIONS

This application claims the benefit under 35 U.S.C. 119(e) of a U.S. provisional patent application of Taso Georgas et al., entitled "Improved Drink Container Sanitary Wipe Attachable To A Drink Container", Ser. No. 62/086,856, filed Dec. 3, 2014, and U.S. provisional patent application of Taso Georgas et al., entitled "Drink Container Sanitary Wipe Attachable To A Drink Container", Ser. No. 61/975,724, filed Apr. 4, 2014, the entire contents of said applications being incorporated herein by reference.

BACKGROUND OF THE INVENTION

Field of the Invention

The present invention relates to a sanitary wipe that is contained beneath or as part of an adhesive sticker that is secured at any convenient point on a container, such as the side or top. For use, the user simply pulls the adhesive sticker free, and uses the wipe part of the sticker wherever they want to use it to clean a container surface, like on the lid of the container.

Description of the Related Art

The ever-increasing public sale of drinks and the use of drink containers therein create a number of issues regarding health and sanitation. Such sales of drinks typically involve a retail establishment that provides a selection of drinks and associated products for consumers to consider. Upon selection, one or more employees of the retail establishment prepare and package the drink for the consumer, often collecting payment at the same time. Prepackaged drinks are simply brought to the point of sale by the employee or the consumer.

However, in this regard, the employee of the establishment may often handle the drink package and lids, payment, and drink preparation equipment, all in an uninterrupted manner. That is, the employee may unknowingly handle a number of different items thereby introducing the opportunity for contamination or cross-contamination of the different items. Further, the consumer themselves when handling the payment and drink package may also unknowingly introduce the opportunity for contamination or cross-contamination of the different items.

The drink package in such situations typically comprises a containment vessel and an optional lid which can be affixed to the vessel to avoid spills. Not all containment vessels include the optional lid, and may simply comprise a top surface that is indented or otherwise configured to be opened by a consumer, such as a can, bottle, or other prepackaged drink containment vessel. Still other containment vessels may comprise a removable film or foil covering to be opened by a consumer. In these cases, the top surface or film cover may become contaminated during manufacturing, storage, delivery, or handling of the containment vessel.

As noted in U.S. Patent Publication No. 2011/0068113 of Stanley Kim, the entire disclosure of which is incorporated herein by reference, during the handling of the optional lid or top surface of the containment vessel, it is inevitable that the hand of the employee or consumer touches the lid, and the area of the lid to be contacted with the lip of a consumer can in this way become contaminated with germs transmitted by the hand of the employee or consumer themselves, which may be a serious public health problem.

Accordingly, in an attempt to address such problems, a number of solutions have been proposed. For example, U.S. Patent Publication No. 2011/0068113 of Stanley Kim noted above, provides a cup lid having an additional covering portion on a top surface. The covering portion is secured at one end and removably extends over the lid opening portion to prevent contamination of the opening. A consumer simply lifts the covering portion to expose the opening and access the contents. A similar covered lid solution is presented in U.S. Pat. No. 8,490,818 of Paul Akers and in U.S. Patent Publication No. 2013/0306663 of Stuchell et al., the entire disclosures of which are incorporated herein by reference. However, such solutions require complicated additional features to the lid, and are only applicable to containment vessels which include such a lid.

In another attempt to address such problems, U.S. Pat. No. 5,692,616 of Dennis Baker, the entire disclosure of which is incorporated herein by reference, provides a package for a cup lid that is removable after the lid is attached to the containment vessel. Attachment to the containment vessel breaks the package open in a manner that permits the user to pull the package material free from the lid after the lid is secured in position. However, again, such a solution requires additional features to the lid, and is only applicable to containment vessels which include such a lid.

Accordingly, a need exists for an improved system and method to address the contamination that can occur to a containment vessel during manufacture, sale and use.

SUMMARY OF THE INVENTION

Accordingly, exemplary embodiments of the present invention substantially solve the above and other issues, and provide a system and method to address the contamination that can occur to a containment vessel during manufacture, sale and use.

An aspect of exemplary embodiments of the present invention is to provide a system and method to address the contamination that can occur to a containment vessel during manufacture, sale and use and which is equally applicable to any type or configuration of containment vessel.

Another aspect of exemplary embodiments of the present invention is to provide a system and method to address the contamination that can occur to a containment vessel during manufacture, sale and use and which is easily used by any consumer or user of the containment vessel.

Another aspect of exemplary embodiments of the present invention is to provide a system and method to address the contamination that can occur to a containment vessel during manufacture, sale and use and which is easily manufactured and/or implemented by anyone in the supply chain of the containment vessel.

Another aspect of exemplary embodiments of the present invention is to provide a system and method to address the contamination that can occur to a containment vessel during manufacture, sale and use and which is easily marked, illustrated and/or shaped to provide use instructions, and identify or advertise a product or service, including those both related to the content of the containment vessel and those unrelated to the content of the containment vessel.

To substantially achieve these and other aspects of the present invention, a sanitary wipe is provided, including a pad that is contained beneath or as part of an adhesive sticker or otherwise attachable body that is secured at any convenient point on a container or containment vessel, such as the side or top of the containment vessel. The pad can be provided with or without a cleaning substance. For use, the user simply pulls the adhesive sticker or attachable body free of the container, and uses the wipe part or pad of the sticker or body to clean and remove contamination wherever contamination is suspected or at any other desired location, like on the lid of the containment vessel.

BRIEF DESCRIPTIONS OF THE DRAWINGS

These and other objects, advantages and novel features of the invention will become more readily appreciated from the following detailed description when read in conjunction with the accompanying drawings, in which.

Figure 8A:
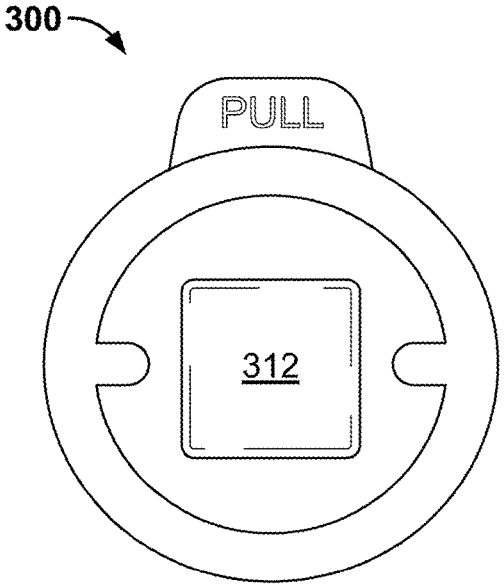
FIGS. 8A, 8B and 8C are top views of a fourth, fifth and sixth exemplary sanitary wipe prior to attachment to a containment vessel in accordance with an embodiment of the present invention.
Figure 8B:
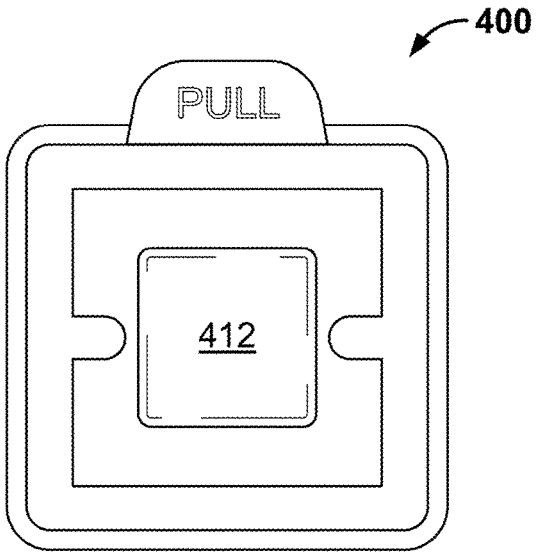
Figure 8C:
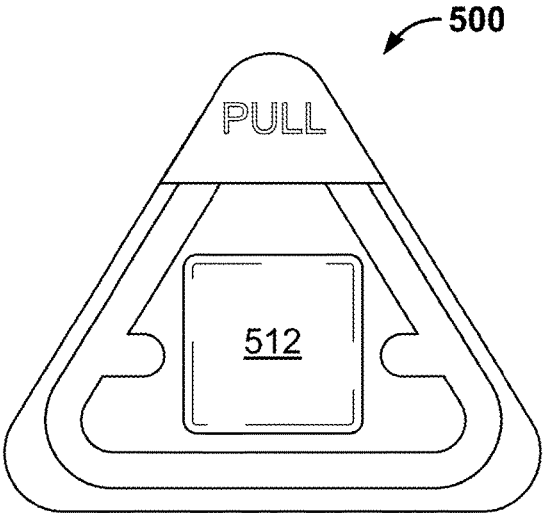
Figure 13:
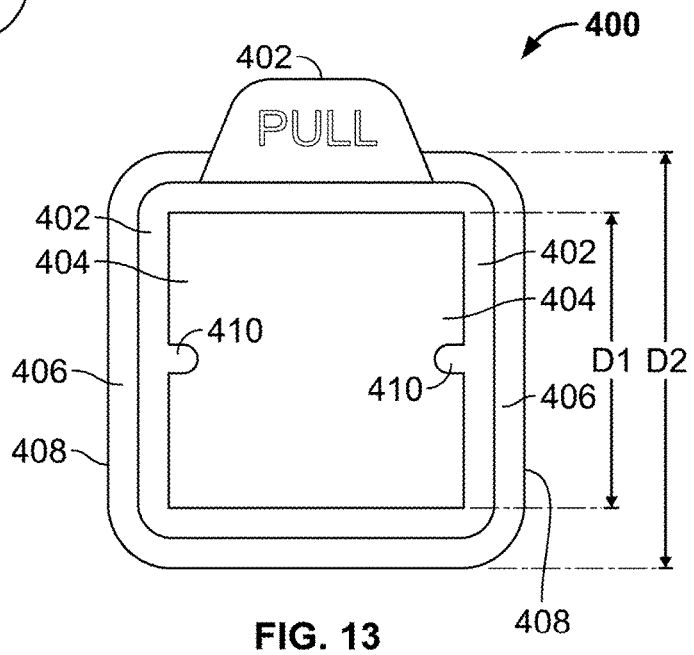
Figure 14:
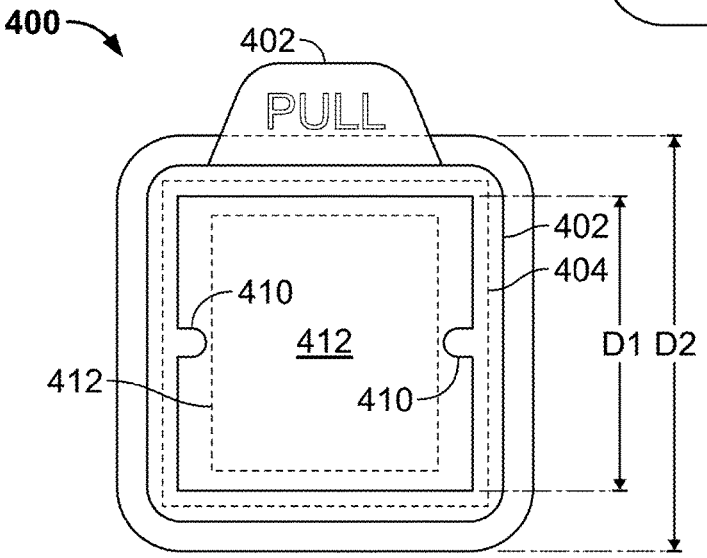
Figure 15:
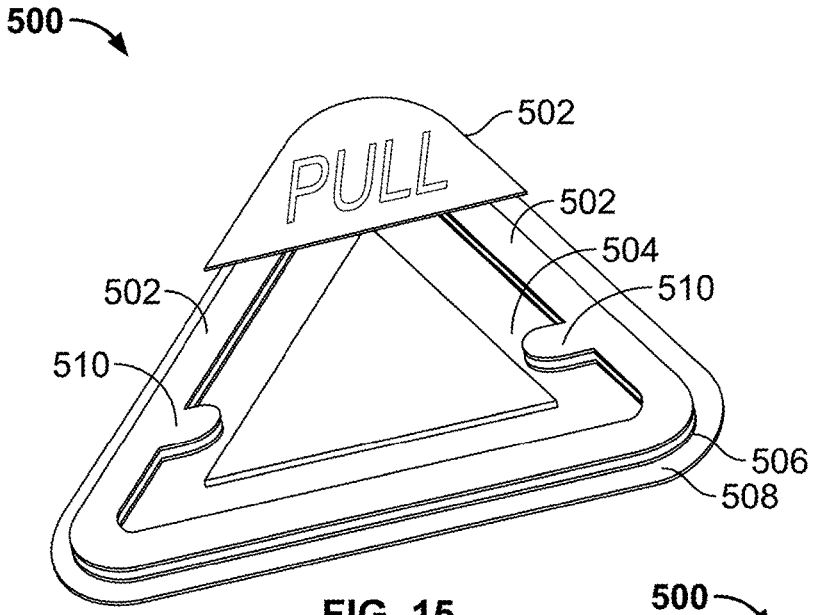
Figure 16:
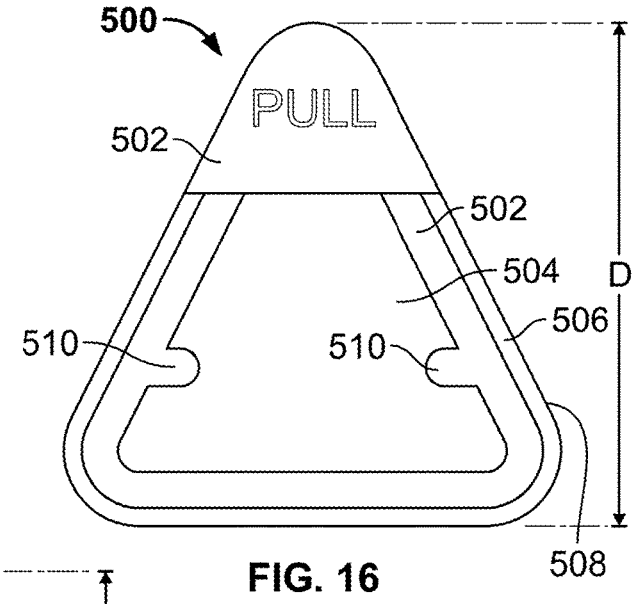
Figure 17:
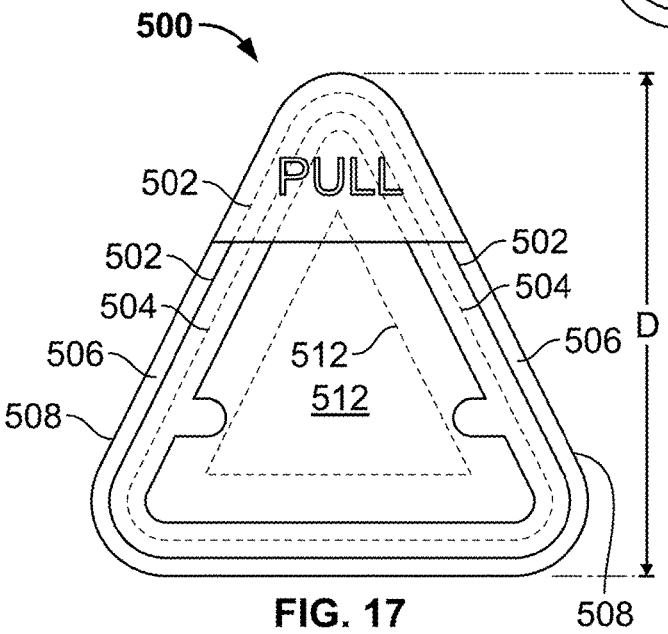
Figure 18:
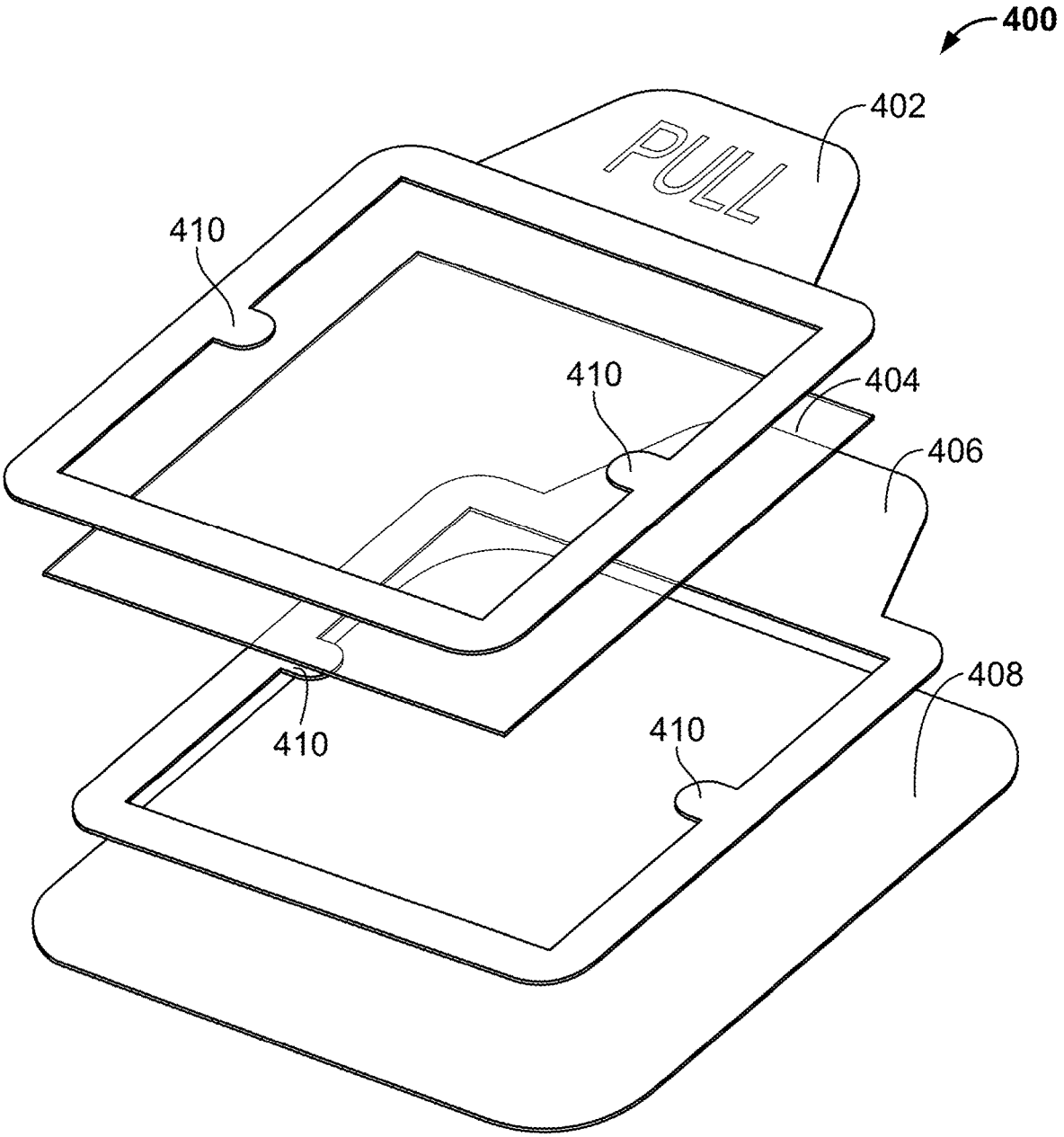
Figure 19:
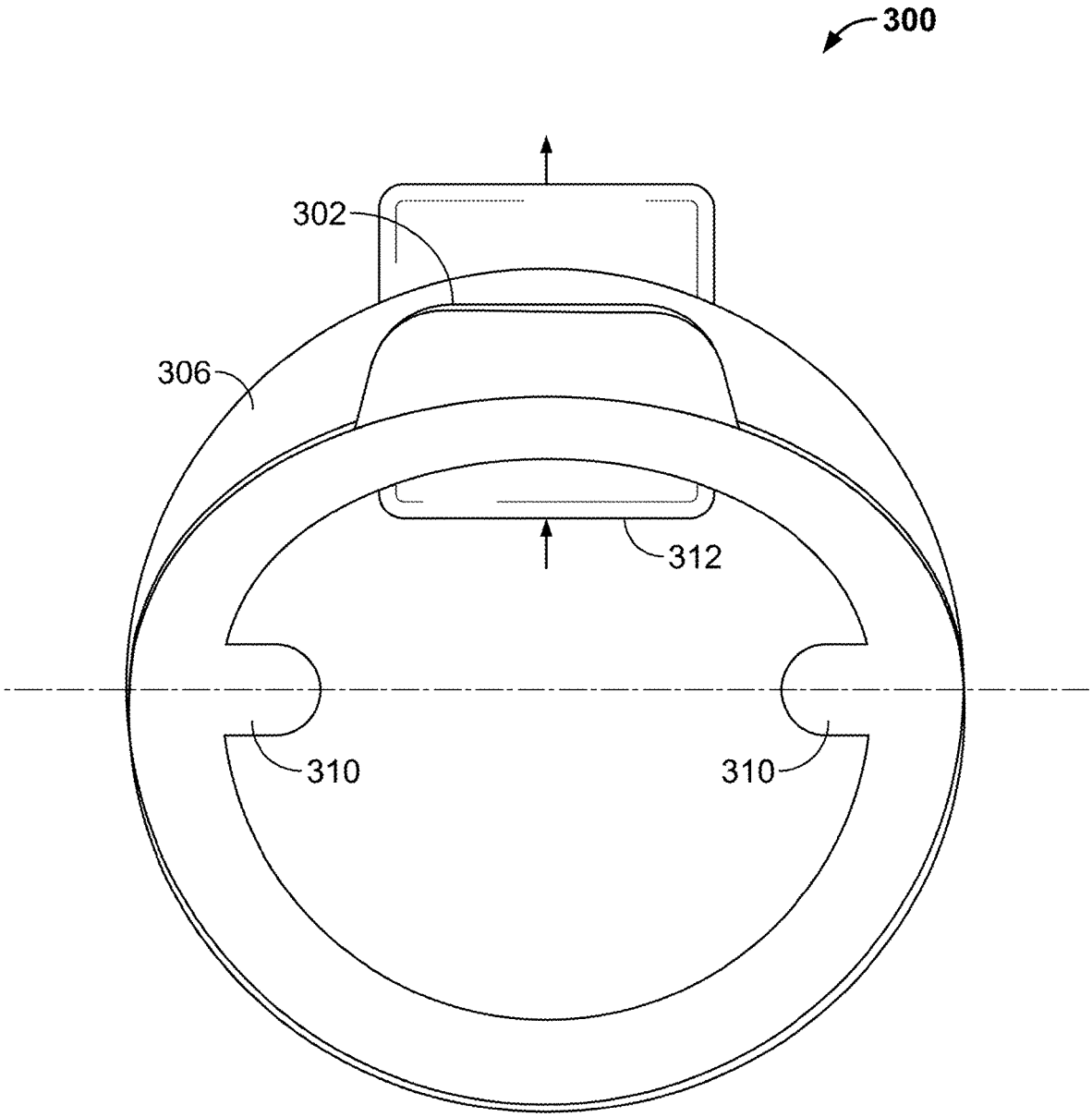

FIG. 13 a mechanical drawing of the fifth exemplary sanitary wipe of FIG. 8B in accordance with an embodiment of the present invention;

FIG. 14 is another mechanical drawing of the fifth exemplary sanitary wipe of FIG. 8B in accordance with an embodiment of the present invention;

FIG. 15 is a perspective view of the sixth exemplary sanitary wipe of FIG. 8C in accordance with an embodiment of the present invention;

FIG. 16 is a mechanical drawing of the sixth exemplary sanitary wipe of FIG. 8C in accordance with an embodiment of the present invention;

FIG. 17 is another mechanical drawing of the sixth exemplary sanitary wipe of FIG. 8C in accordance with an embodiment of the present invention;

FIG. 18 is an exploded enlarged view of the fifth exemplary sanitary wipe of FIG. 8B in accordance with an embodiment of the present invention; and FIG. 19 is an operational view of the fourth exemplary sanitary wipe of FIG. 8A in accordance with an embodiment of the present invention.

Throughout the drawings, like reference numerals will be understood to refer to like parts, components and structures.

DETAILED DESCRIPTION OF EXEMPLARY EMBODIMENTS

As shown in the attached figures, a sanitary wipe is provided, including a pad that is contained beneath or as part of an adhesive sticker or otherwise attachable body that is releasably secured at any convenient point on a surface of a container or containment vessel, such as the side or top of the containment vessel. The pad can be provided with or without a cleaning substance. For use, the user simply pulls the adhesive sticker or attachable body free of the container, and uses the wipe part or pad of the sticker or body to clean and remove contamination wherever contamination is suspected or at any other desired location, like on the lid of the containment vessel.

Figure 1:
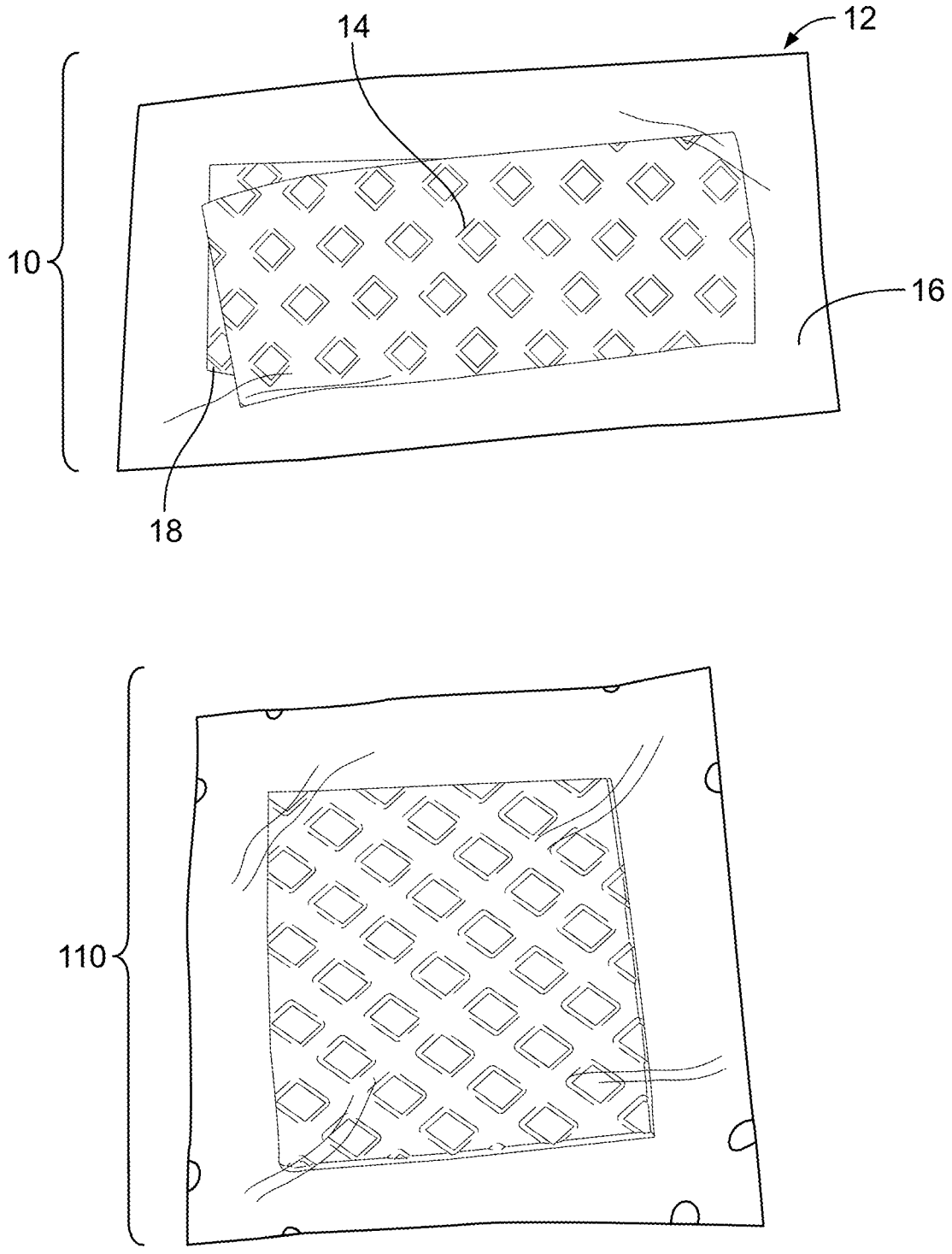
FIG. 1 is a top view of a first and second exemplary sanitary wipe prior to attachment to a containment vessel in accordance with an embodiment of the present invention.
Figure 2:
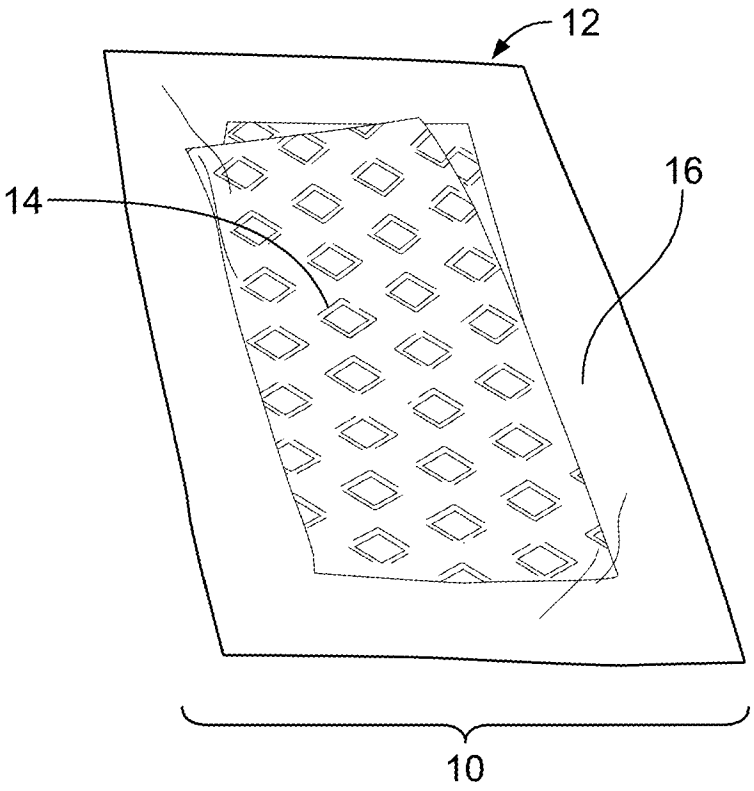
FIG. 2 is another top view of the first and second exemplary sanitary wipes of FIG. 1 in accordance with an embodiment of the present invention.
Figure 2:
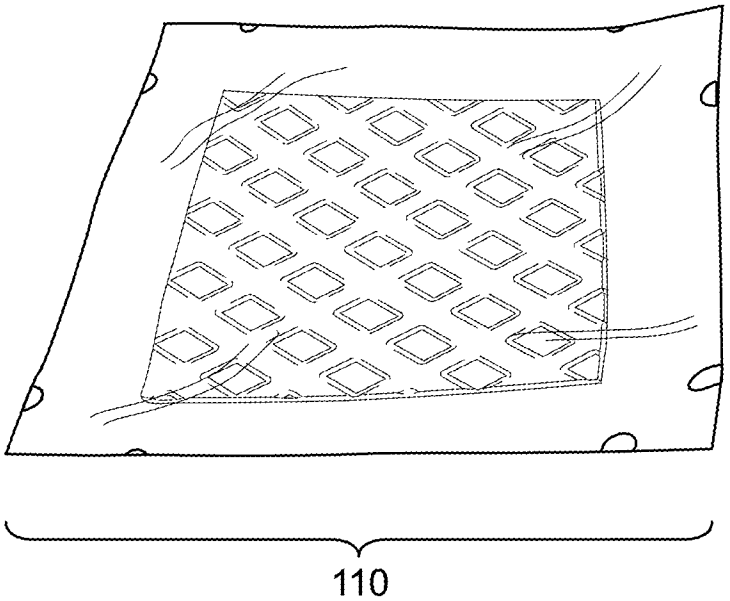
Figure 3:
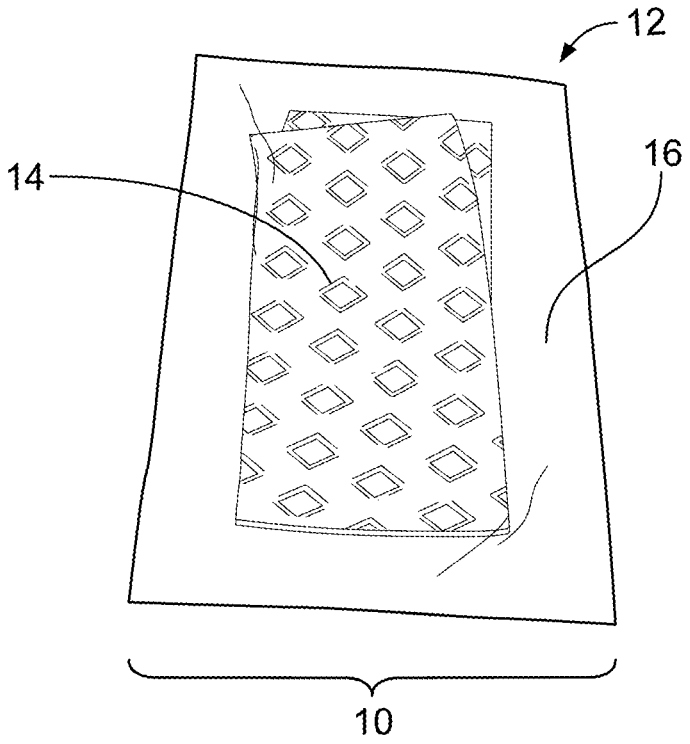
FIG. 3 is another top view of the first exemplary sanitary wipe of FIG. 1 in accordance with an embodiment of the present invention.
Figure 4:
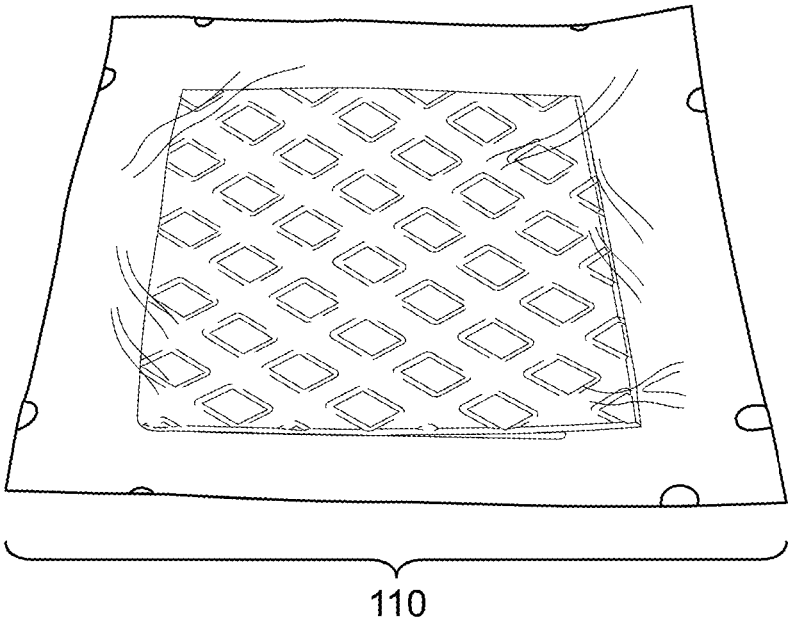
FIG. 4 is another top view of the second exemplary sanitary wipe of FIG. 1 in accordance with an embodiment of the present invention.
Figure 6:
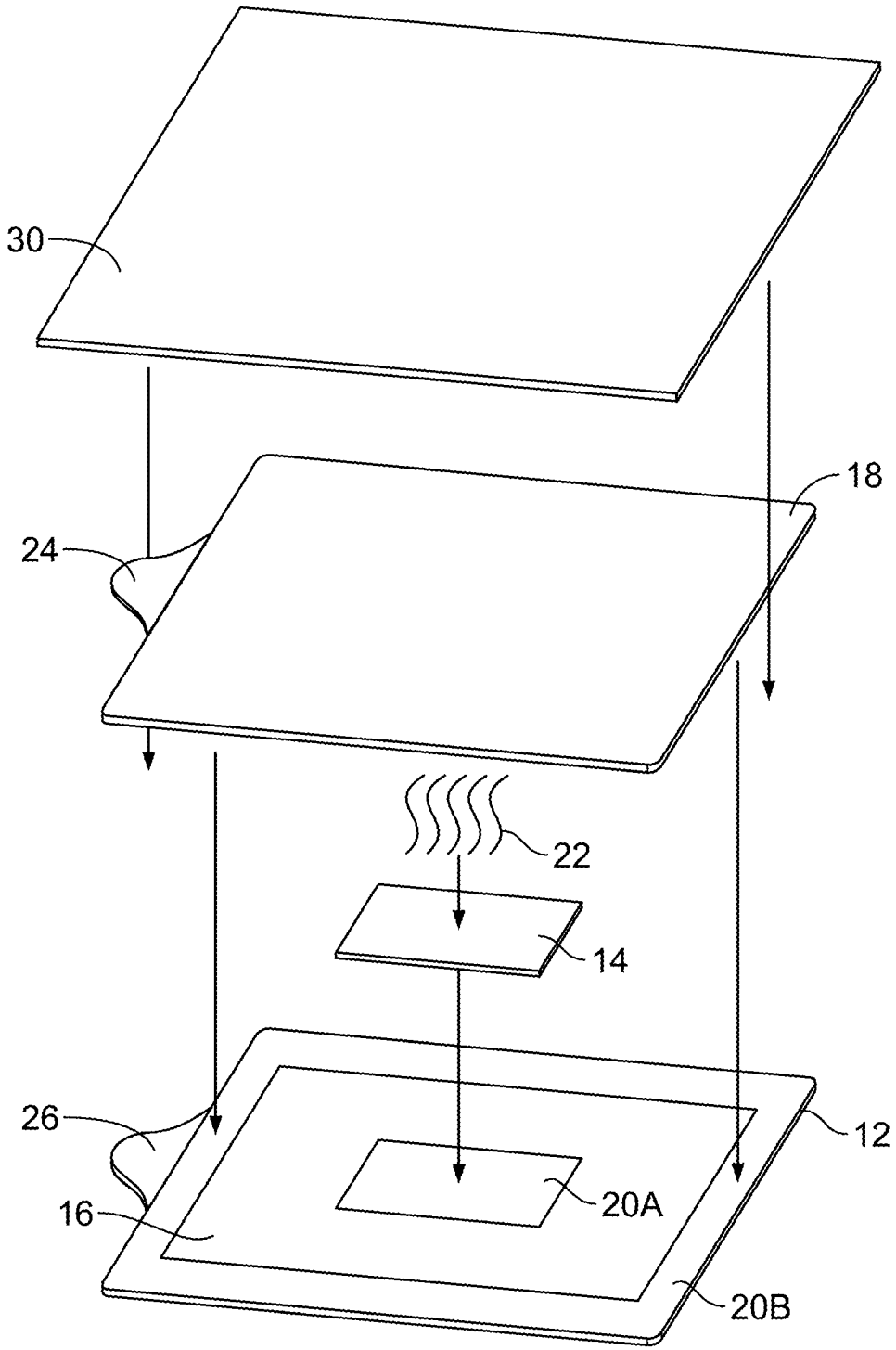
FIG. 6 is an exploded enlarged view of the first exemplary sanitary wipe of FIG. 1 in accordance with an embodiment of the present invention.
Figure 7:
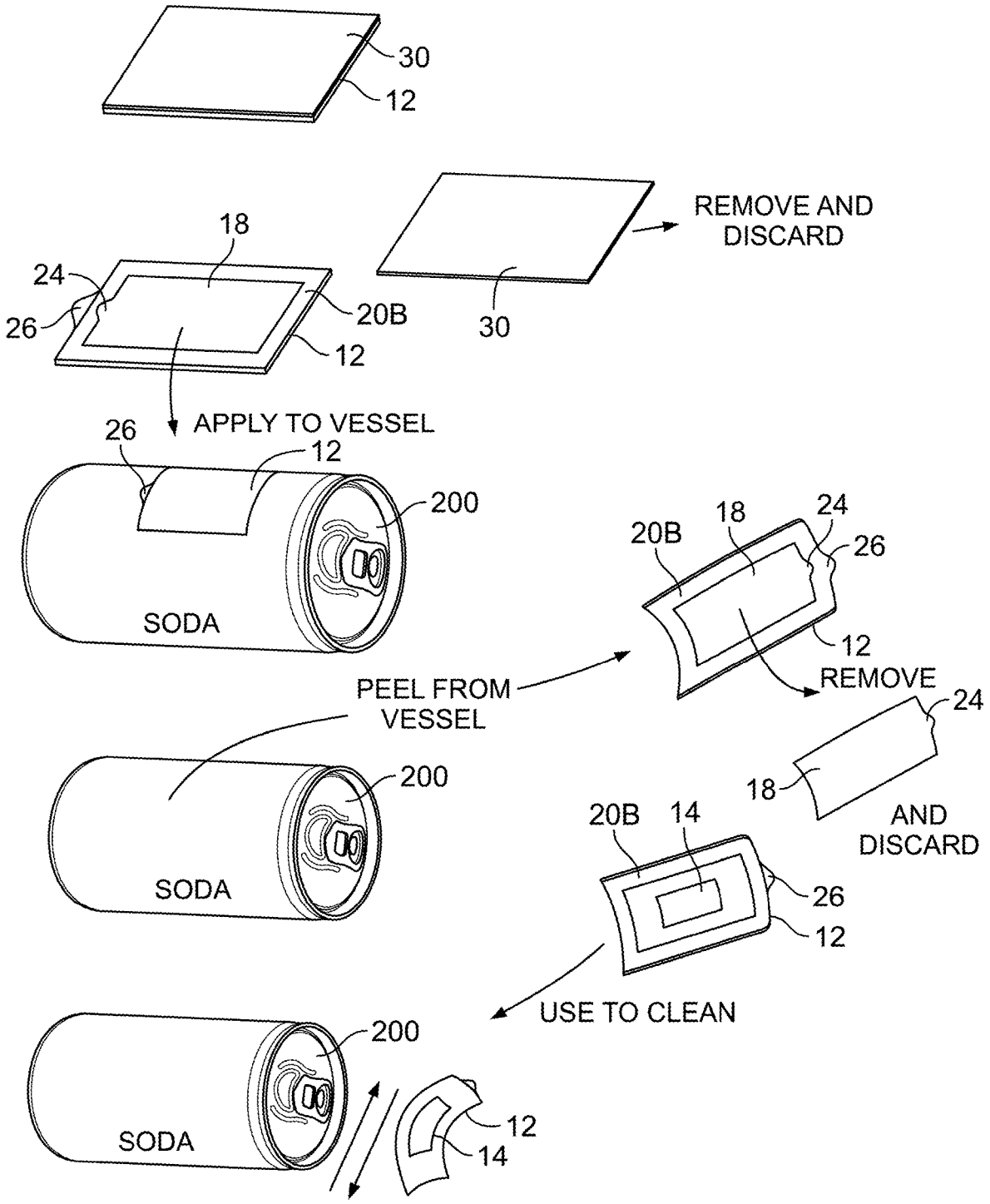
FIG. 7 is a view of the first exemplary sanitary wipe of FIG. 1 illustrating attachment to a containment vessel, removal from the containment vessel, and use in cleaning the containment vessel, in accordance with an embodiment of the present invention.

FIGS. 1 and 2 are enlarged top views of both a first and second exemplary sanitary wipe prior to attachment to a containment vessel in accordance with an embodiment of the present invention. FIG. 3 is another enlarged top view of the first exemplary sanitary wipe of FIG. 1, and FIG. 4 is another enlarged top view of the second exemplary sanitary wipe of FIG. 1. FIG. 6 is an exploded enlarged view of the first exemplary sanitary wipe of FIG. 1 and FIG. 7 is a view of the first exemplary sanitary wipe of FIG. 1 illustrating attachment to a containment vessel, removal from the containment vessel, and use in cleaning the containment vessel in accordance with an embodiment of the present invention.

In the embodiments of FIGS. 1-4, exemplary sanitary wipes are shown prior to attachment to a containment vessel. The exemplary sanitary wipes are formed as adhesive films that are releasably attachable to a containment vessel and which can comprise any number of colors, markings and shapes, such as circular, oval, square, rectangular, triangular or otherwise. The shape, color or markings of the body of the sanitary wipe can be used to identify the cleaning substance or lack of cleaning substance of the pad therein and provided by the sanitary wipe. The shape, color or markings of the body of the sanitary wipe can also be used to identify the content of the containment vessel. For example, novelty colors, markings and shapes of the body of the sanitary wipes can be configured to serve as marketing or advertisement tools of the containment vessel upon which the sanitary wipe is secured. Further, the bodies of the sanitary wipes can have specific colors, markings and shapes that are indicative of the expected temperature of the contents of the containment vessel. For example, exemplary sanitary wipes can be constructed to have a red color or triangular body shape to advise caution or denote hot content of the containment vessel. For illustrative purposes herein, a rectangular sanitary wipe 10 having a clear top cover or body, and a square sanitary wipe 110 also having a clear top cover or body are shown by way of example in FIGS. 1 and 2. The clear top cover of each 10, 110 permits the views of the elements of the sanitary wipe for purposes of the following description, but embodiments are not limited to such a clear top cover.

The first exemplary sanitary wipe 10 of FIGS. 1, 2 and 3 comprises a substantially rectangular body 12, having a top surface and a bottom surface. The second exemplary sanitary wipe 110 of FIGS. 1, 2 and 4 comprises a substantially square body for illustration purposes, but is otherwise as described below in regard to the first exemplary sanitary wipe 10. A clear top surface of the sanitary wipes as appearing to a final user is shown in FIGS. 1-4. The top surface of the sanitary wipes is substantially flat, but can be shaped, textured, marked or illustrated with logos, or otherwise colored, as described in greater detail below.

As shown in FIGS. 1-3, 6 and 7, the body 12 comprises a substantially rectangular film constructed of a waterproof, biodegradable and/or recycled film, biodegradable form of cotton, and/or any suitable material that, for example, allows for adhesion to a containment vessel and securing a pad thereto. The body 12 is flexible and therefore suitable to attach to any flat, curved or contoured containment vessel surface, and is compatible with a wide range of containment vessel surface temperatures and containment vessel surface textures without failing.

As noted, the film of the body 12 and/or a top surface thereof, can be shaped, textured, marked or illustrated with logos, advertisements of local interest, coupons, prizes, bar codes, text code protection or visual markings, or otherwise colored, opaque or clear. The body 12 is preferably between 1 and 3 inches wide, 1 and 4 inches long, and ⅛ to ½ inches thick, but is not limited thereto. A corner or other portion 26 of the body 12 can be provided free of adhesive and extending in a manner such that the user can grip the portion 26 and pull the body 12 free from the containment vessel as shown in FIG. 7, thereby exposing a pad 14 beneath the body 12 for use.

To do so, a portion of the bottom surface of the body 12 includes the pad 14 disposed thereon. The pad 14 can comprise a same or similar shape as the body 12, but having smaller dimensions, but is not limited thereto. The smaller dimensions of the pad 14 permits the pad 14 to be secured to or against the bottom surface of the body 12, while permitting a surrounding portion of the bottom surface of the body 12 to be used to secure the body 12 and pad 14 to the surface of a containment vessel as described in greater detail below. The pad 14 is preferably between ½ and 2 inches wide, ½ and 3 inches long, and 1/16 to ⅛ inches thick, but is not limited thereto. The pad 14 is preferably positioned at a geometric center position of the bottom surface of the body 12, but can be positioned anywhere on the bottom surface of the body 12. A single pad 14 is shown, but embodiments are not limited thereto. In other embodiments, multiple pads with same or different properties, can be stacked or otherwise provided in the available space.

FIG. 6 is an exploded enlarged view of the first exemplary sanitary wipe of FIG. 1 in accordance with an embodiment of the present invention. As shown in FIG. 6, the first exemplary sanitary wipe includes a body 12 having a user grip portion 26 and adhesive layers 20A and 20B, a pad 14, a substance 22 to be contained by the pad 14, a pad cover 18 having a user grip portion 24, and an additional packaging cover 30, however embodiments of the present invention are not limited thereto. In other applications, elements can be omitted or rearranged as desired.

The body 12 can be constructed of a colored, opaque or clear film having a user grip portion 26 and adhesive layers 20A and 20B on the bottom surface. The pad 14 is secured to the body 12 using the adhesive layer 20A or similar material, but embodiments are not limited thereto. In yet other embodiments of the present invention, the body 12 can be constructed such that a portion of the body 12 itself serves as the pad 14. For example, where the body 12 is constructed of a material that can function as the pad, that is, by providing a cleansing surface or by providing a cleansing surface and containing a cleaning substance, a portion of the body 12 can serve as the pad, and the separate pad 14 can be omitted. In yet other embodiments of the present invention, the pad can be free from the body, and simply held in position by the assembled elements until released for use.

At least one affixing portion of the bottom surface of the body 12 is preferably not covered by the pad 14. This affixing portion 16 is preferably used to releasably secure the body 12 and pad 14 to a containment vessel for use. In the exemplary embodiment shown in FIGS. 1, 2, 3 and 6, the pad 14 is centered on the bottom surface of the body 12 such that the affixing portion 16 is provided as the exposed bottom surface of the body surface 12 surrounding the pad 14 and extending from the pad 14 to the edge of the body 12. As shown in FIG. 6, the affixing portion 16 comprises band-shaped adhesive layer 20B or similar material disposed as a border of the affixing portion 16 substantially encircling the pad 14, and is used to releasably secure the bottom surface of the body 12 and pad 14 to a containment vessel for use. The adhesive layer 20B is also used to releasably secure the pad cover 18 to the bottom surface of the body 12 and thereby releasably covering the pad 14 as described in greater detail below. The adhesive layer 20B can comprise a band-shape matching that of the bottom surface of the body 12 and have a width to provide a band of adhesive wide enough to releasably secure the bottom surface of the body 12 and pad 14 to a containment vessel for use, and releasably secure the pad cover 18 to the bottom surface of the body 12, but is not limited to the shape and width shown.

The adhesive or other material of the adhesive layer 20B of the affixing portion 16 can be the same as the adhesive or other material of the adhesive layer 20A used to secure the pad 14 to the bottom surface of the body 12, thereby simplifying manufacture of the sanitary wipe, but is not limited thereto. The adhesive layer 20B is preferably suitable to releasably attach the bottom surface of the body 12 and pad 14 to any containment vessel surface, and is compatible with a wide range of containment vessel surface contours, textures and temperatures without failing. The adhesive layer 20A is preferably suitable to attach any pad material 14 to the bottom surface of the body 12, and is compatible with a wide range pad materials, cleaning substances, contours, textures and temperatures without failing. The adhesive layer 20A can comprise a shape and dimension matching that of the pad 14, but is not limited to the shape and width shown.

As noted above, the adhesive of the adhesive layer 20B of the affixing portion 16 can be the same as the adhesive of the adhesive layer 20A used to secure the pad 14 to the bottom surface of the body 12, thereby simplifying manufacture of the sanitary wipe, but is not limited thereto. In such an embodiment where a single adhesive is used, the adhesive layers 20A and 20B can be provided in a single, continuous layer (not shown) on the bottom surface of the body 12 to both secure the pad 14 to the bottom surface of the body 12, releasably secure the pad cover 18 to the bottom surface of the body 12, and releasably secure the bottom surface of the body 12 and pad 14 to the containment vessel.

In yet other embodiments where a single adhesive is used, the adhesive layers 20A and 20B can be provided in separated layers on the bottom surface of the body 12, wherein one layer 20A is used to secure the pad 14 to the bottom surface of the body 12, and one layer 20B is used to releasably secure the pad cover 18 to the bottom surface of the body 12, and releasably secure the bottom surface of the body 12 and pad 14 to the containment vessel.

In yet other embodiments, the adhesive of the adhesive layers 20A and 20B can be comprised of two or more different adhesives. In such an embodiment, the adhesive layers 20A and 20B can be provided in separated layers on the bottom surface of the body 12, wherein one layer 20A is used to secure the pad 14 to the bottom surface of the body 12, and one layer 20B is used to releasably secure the pad cover 18 to the bottom surface of the body 12, and releasably secure the bottom surface of the body 12 and pad 14 to the containment vessel. In each embodiment, the adhesive is preferably comprised of a waterproof and/or biodegradable adhesive.

The pad 14 can comprise any suitable material, such as a biodegradable absorbent material, such as cotton or synthetic cotton that can be used to absorb and store a cleaning substance until applied from the pad 14 to a surface by a user, or an abrasive or textured biodegradable scrubbing material. In an exemplary embodiment, the pad 14 is provided with the substance 22, such as a biodegradable cleaning or sanitizing substance that is safe for use with eating and drinking utensils. In yet other embodiments, the substance 22 can be omitted from the pad 14. Further, as noted above, where the body 12 is constructed of a material that can function as the pad, a portion of the body 12 can serve as the pad, and the separate pad 14 can be omitted.

As shown in FIG. 6, the removable film or pad cover 18 is placed on the bottom surface of the body 12 to substantially cover the pad 14 and extend beyond the boundaries of the pad 14 and into the affixing portion 16 and secured by a portion of the adhesive layer 20B. The pad cover 18 is provided to cover the pad 14 as secured by a portion of the adhesive layer 20B and therefore, when the sanitary wipe 10 is in position on a containment vessel, the pad cover 18 is positioned between the pad 14 and the surface of the containment vessel.

The pad cover 18 is large enough to cover the pad 14 and extend beyond the boundaries of the pad 14 and into the affixing portion 16 and the adhesive layer 20B, but small enough to leave a portion of the adhesive layer 20B exposed to secure the body 12 to a containment vessel. In doing so, the edge of the pad cover 18 is sealed to the bottom surface of the body 12 by a portion of the adhesive layer 20B, and the remaining portion of the adhesive layer 20B is used to releasably secure the body 12 to a containment vessel when the sanitary wipe is installed onto the surface of a containment vessel. Once the pad cover 18 is sealed by the adhesion to the adhesive layer 20B, and the adhesion of the adhesive layer 20B to the containment vessel surface, the pad 14 is protected from contamination from all directions, and protected from releasing any substance prior to removal and use.

As noted above, a corner or other user grip portion 26 of the body 12 can be provided free of the adhesive layer 20B and extended in a manner such that the user can grip the portion 26 and pull the body 12 free from the containment vessel as shown in FIG. 7, thereby exposing the pad cover 18 beneath the body 12 for removal. As shown in FIGS. 6 and 7, a corner or other user grip portion 24 of the pad cover 18 can be provided such that once the body 12 has been pulled free from the containment vessel, the user can grip the portion 24 and pull the pad cover 18 free from the bottom surface of the body 12 as shown in FIG. 7, thereby exposing the pad 14 for use.

Figure 5:
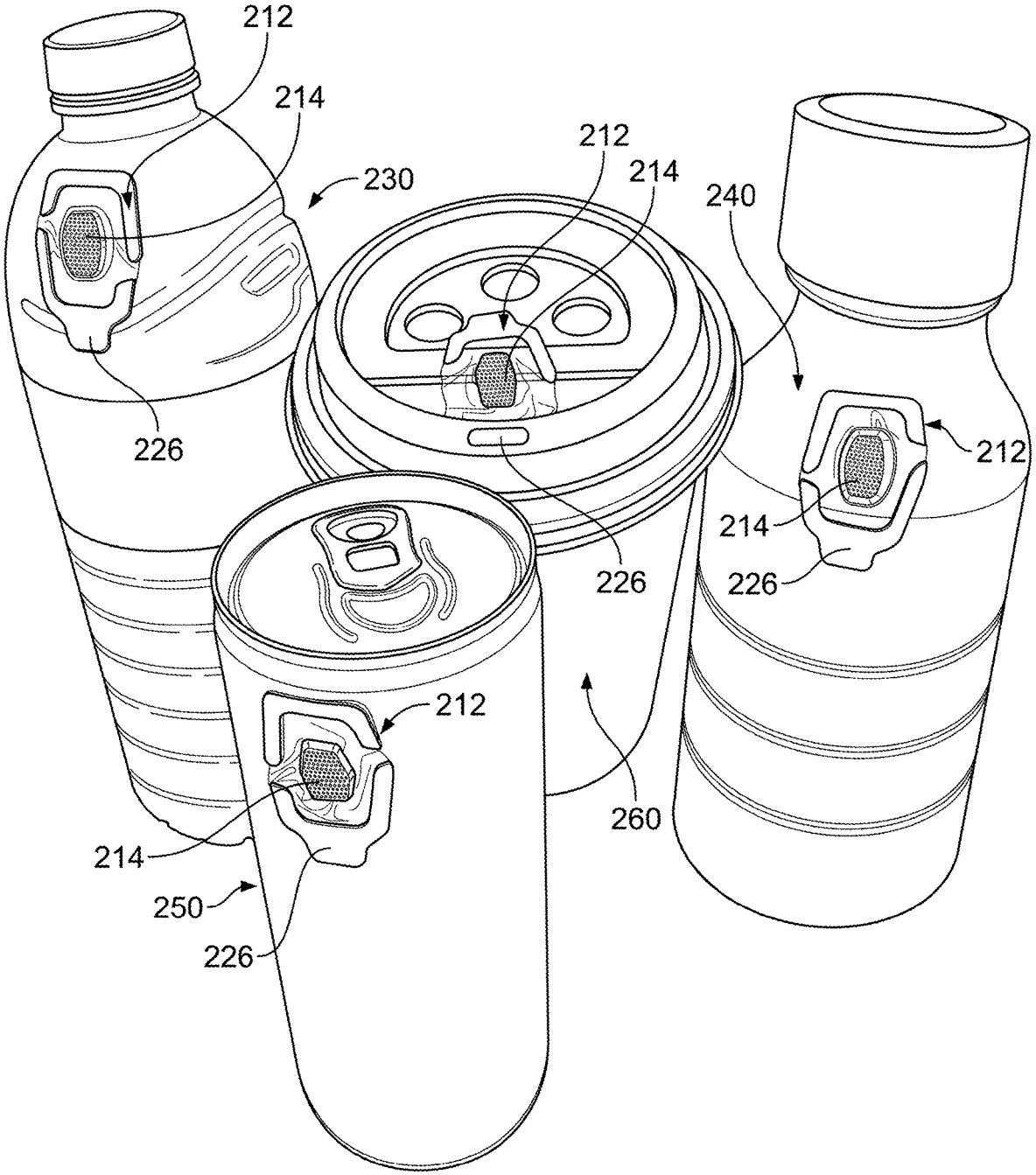
FIG. 5 is a perspective view of third exemplary sanitary wipes after attachment to exemplary containment vessels in accordance with an embodiment of the present invention.

As shown in FIG. 7, the body 12 and pad 14, including the pad cover 18, can be attached to a containment vessel 200 at the time and place of manufacture of the containment vessel, or at any time thereafter. Since the body 12 and pad 14 can be provided with the additional packaging cover 30 and pad cover 18, the sanitary wipes of the present invention can be separately manufactured and distributed to intermediate users for placement on a variety of containment vessels. The additional packaging cover 30 can be provided to releasably cover the entire bottom surface of the body 12 including the exposed adhesive layer 20B permitting distribution of the sanitary wipes to intermediate users for later placement on a variety of containment vessels. The additional packaging cover 30 can also be provided as part of a package for containing the entire sanitary wipe 10 after manufacture of the wipe and provided to protect the wipe during distribution to the intermediate users for placement on a variety of containment vessels. The intermediate users can then simply remove the sanitary wipe from packaging and/or remove the additional packaging cover 30 to expose the portion of the adhesive layer 20B on the bottom surface of the body 12 for placement of the sanitary wipe on a variety of containment vessels, as shown for example in FIG. 5. FIG. 5 is a view of third exemplary sanitary wipes after attachment to exemplary containment vessels in accordance with an embodiment of the present invention.

The third exemplary sanitary wipe is constructed substantially similar to the first and second exemplary sanitary wipes described above, and the pad 214 can be secured to the body 212 as described above or the pad 214 can be free from the body 212, and simply held in position by the assembled elements until released for use as described below. In the attached position, the body portion 212 is visible in a number of attached positions with a conventional bottle 230 and conventional cup 260, and a product specific bottle 240 and can 250 illustrating how embodiments of the present invention are equally applicable to any style of containment vessel with or without a lid. The body portion of the third exemplary sanitary wipe is clear, such that the pad 214 is visible. A user grip portion 226 of the body 212 is provided extending in a manner such that the user can grip the portion and pull the body 212 free from the containment vessel, thereby exposing the pad cover (not shown) for removal, and thereafter use of the pad 214.

A "breaking point" can be provided at the discontinuous points of the body 212 for single-hand operation in the case where the pad 214 is free from the body 212, and simply held in position by the assembled elements until released for use. As shown in FIG. 5, the body 212 can be discontinuous around a perimeter encircling the pad 214, providing points secured using clear body portions. In use, the breaking point provides a point where the body 212 bends or flips back during removal from a containment vessel surface while the pad stays secure, thereby exposing the pad 214 beneath the body 212 for easy removal.

An exemplary use of an embodiment of the present invention is illustrated in FIG. 7. FIG. 7 is a view of the first exemplary sanitary wipe 10 of FIG. 1 illustrating attachment to a containment vessel, removal from the containment vessel, and use in cleaning a portion of the containment vessel in accordance with an embodiment of the present invention. As shown in FIG. 7, an assembled sanitary wipe 10 of FIG. 6 can be provided for attachment. Since the body 12 and pad 14 are provided with the additional packaging cover 30 and pad cover 18, the sanitary wipes of the present invention can be separately manufactured and distributed to intermediate users for placement on a variety of containment vessels, such as the containment vessel 200. The attachment location, and variety of containment vessel for such attachment, can vary as illustrated in FIG. 5.

As shown in FIGS. 6 and 7, the additional packaging cover 30 can be provided to releasably cover the entire bottom surface of the body 12 including the exposed adhesive layer 20B portion permitting distribution of the sanitary wipes to intermediate users for later placement on a variety of containment vessels. The intermediate users can simply remove the sanitary wipe from packaging and/or remove and discard the additional packaging cover 30 to expose the adhesive layer 20B on the bottom surface of the body 12 for placement of the sanitary wipe on a variety of containment vessels. Once placed onto the containment vessel, embodiments of the present invention serve to prevent contamination that can occur during further manufacture, sale and use, and which is easily removed and further used by any consumer or user of the containment vessel to clean and remove contamination wherever contamination is suspected or at any other desired location, like on the lid of the containment vessel.

As further illustrated in FIG. 7, a corner or other user grip portion 26 of the body 12 can be provided free of the adhesive layer 20B and extended in a manner such that the user can grip the portion 26 and pull the body 12 free from the surface of the containment vessel 200, thereby exposing the pad cover 18 beneath the body 12. A corner or other user grip portion 24 of the pad cover 18 can be provided extending in a manner such that the user can grip the portion 24 and pull the pad cover 18 free from the adhesive layer 20B as shown in FIG. 7, thereby exposing the pad 14 for use. The user can then use the exposed pad 14 and contents thereof if provided, to clean and remove contamination wherever contamination is suspected or at any other desired location, like on the lid of the containment vessel 200 as indicated by the back and forth arrows denoting a wiping motion in FIG. 7. In yet another benefit, the sanitary pad can be used to clean other surfaces or spills that may occur during or after use.

FIGS. 8A, 8B and 8C are top views of a fourth, fifth and sixth exemplary sanitary wipe prior to attachment to a containment vessel in accordance with an embodiment of the present invention. In the embodiments of FIGS. 8A, 8B and 8C, the pad can simply be captured and held in place beneath a clear film layer as described in greater detail below, which permits easy removal and use when one or more top layers are partially pulled away from the containment vessel. FIG. 8A shows a circle shaped embodiment, FIG. 8B shows a square shaped embodiment, and FIG. 8C shows a triangle shaped embodiment, each having a square shaped pad, but embodiments are not limited thereto. For example, FIG. 11 shows a circle shaped pad, FIG. 14 shows a square shaped pad, and FIG. 17 shows a triangle shaped pad.

In the embodiments of FIGS. 8A, 8B and 8C, the above described features and uses of the first, second and third embodiments can be provided, as well as a "pull" tab and a center breaking point or line as described in greater detail below. As noted above, the circular, square and triangular shape of the body of the sanitary wipe can be used to identify the cleaning substance or lack of cleaning substance of the pad therein; can be used to identify the content of the containment vessel; can be used to indicate the expected temperature of the contents of the containment vessel; and/or can be used to serve as marketing or advertisement tools of the containment vessel.

Figure 9:
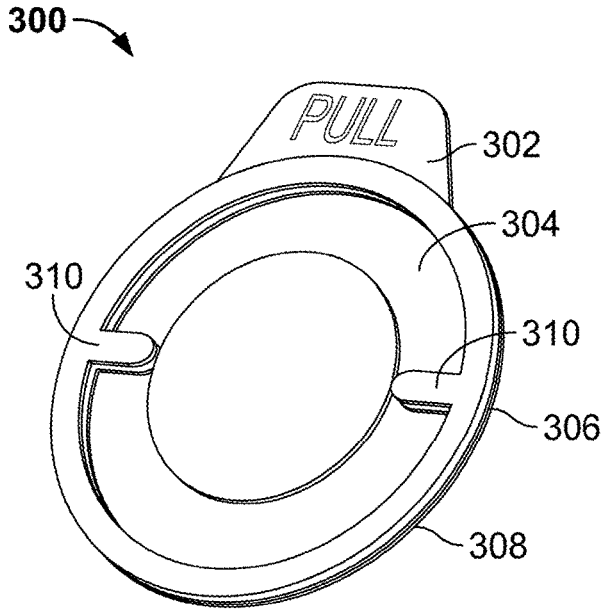
FIG. 9 is a perspective view of the fourth exemplary sanitary wipe of FIG. 8A in accordance with an embodiment of the present invention.
Figure 10:
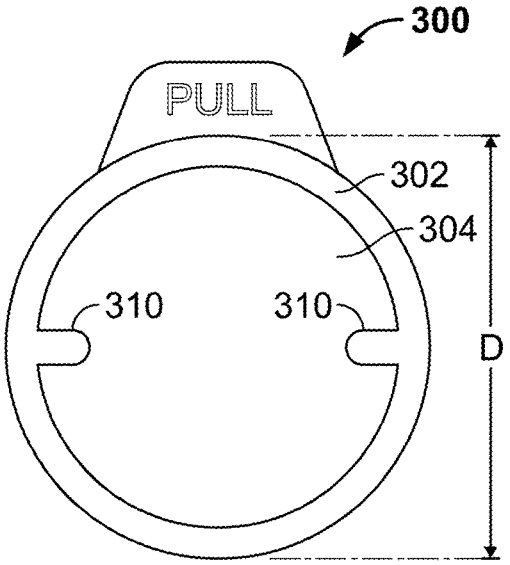
FIG. 10 is a mechanical drawing of the fourth exemplary sanitary wipe of FIG. 8A in accordance with an embodiment of the present invention.
Figure 11:
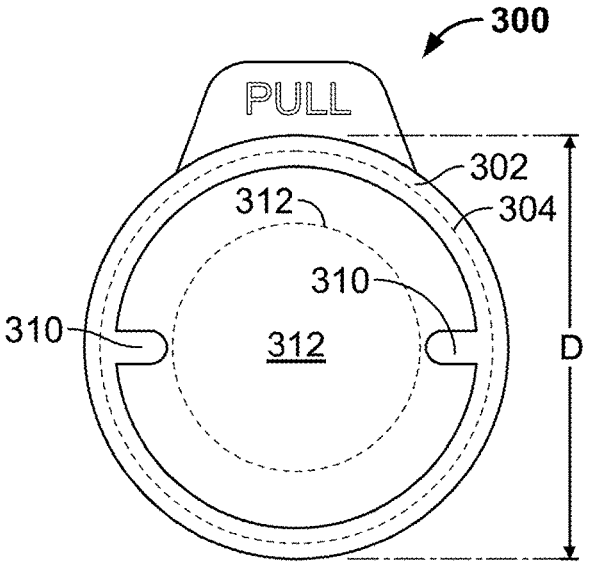
FIG. 11 is another mechanical drawing of the fourth exemplary sanitary wipe of FIG. 8A in accordance with an embodiment of the present invention.

FIG. 9 is a perspective view of the fourth exemplary sanitary wipe of FIG. 8A in accordance with an embodiment of the present invention, and FIGS. 10 and 11 are mechanical views of the fourth exemplary sanitary wipe. The sanitary wipe 300 is substantially circular shaped, having a pull tab layer 302 with an outer diameter D and a center opening, a clear film 304 beneath the center opening of the pull tab layer and having a pad 312 thereunder (see FIG. 8A), an adhesive layer 306 with an outer diameter D and center opening beneath the clear film, and an adhesive backing 308 with an outer diameter D beneath the adhesive layer. One side of the adhesive layer 306 secures the clear film layer 304 to the pull tab layer 302, and an opposite side of the adhesive layer 306 is secured to the containment vessel surface (not shown) after removal of the adhesive backing 308. A breaking point 310 is provided at the detents on opposite sides of the pull tab layer for single-hand operation. In use, the breaking point 310 provides a point where the pull tab layer 302 bends or flips back during removal from a containment vessel surface while the pad stays secure, thereby exposing the pad 312 beneath the clear film layer 304 for easy removal. The pull tab layer 302, clear film layer 304 and adhesive layer 306 simply bend or flip back during removal from a containment vessel surface, thereby exposing the pad 312 beneath the clear film 304 for easy removal and use.

In one embodiment shown in FIG. 10, the outer diameter D is between 1.25 and 1.50 inches, and preferably 1.375 inches, but embodiments are not limited thereto.

Figure 12:
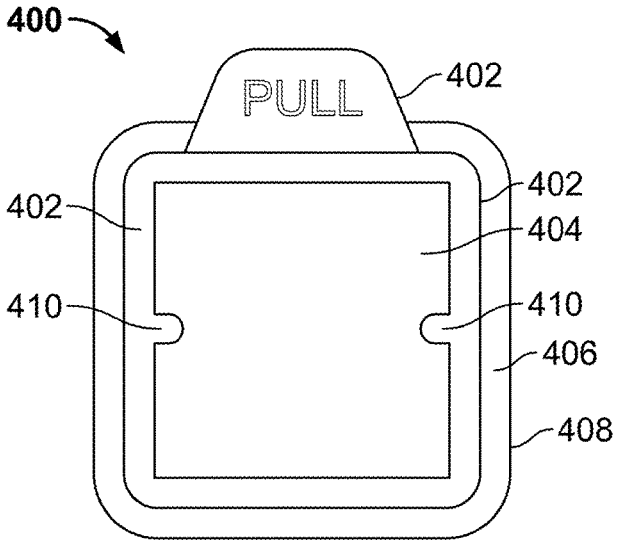
FIG. 12 is a perspective view of the fifth exemplary sanitary wipe of FIG. 8B in accordance with an embodiment of the present invention.

FIG. 12 is a perspective view of the fifth exemplary sanitary wipe of FIG. 8B in accordance with an embodiment of the present invention, and FIGS. 13 and 14 are mechanical views of the fifth exemplary sanitary wipe. The sanitary wipe 400 is substantially square shaped, having a pull tab layer 402 with a center opening of width D1, a clear film 404 beneath the center opening of the pull tab layer and having a pad 412 thereunder (see FIG. 8B), an adhesive layer 406 with a width D2 and center opening beneath the clear film, and an adhesive backing 408 with a width D2 beneath the adhesive layer. One side of the adhesive layer 406 secures the clear film layer 404 to the pull tab layer 402, and an opposite side of the adhesive layer 406 is secured to the containment vessel surface (not shown) after removal of the adhesive backing 408. A breaking point 410 is provided at the detents on opposite sides of the pull tab layer for single-hand operation. In use, the breaking point 410 provides a point where the pull tab layer 402 bends or flips back during removal from a containment vessel surface while the pad stays secure, thereby exposing the pad 412 beneath the clear film 404 for easy removal. The pull tab layer 402, clear film layer 404 and adhesive layer 406 simply bend or flip back during removal from a containment vessel surface, thereby exposing the pad 412 beneath the clear film 404 for easy removal and use.

In one embodiment shown in FIG. 13, the width D1 is between 0.80 and 1.20 inches, and preferably 0.98 inches, and the width D2 is between 1.25 and 1.50 inches, and preferably 1.380 inches, but embodiments are not limited thereto.

FIG. 15 is a perspective view of the sixth exemplary sanitary wipe of FIG. 8C in accordance with an embodiment of the present invention, and FIGS. 16 and 17 are mechanical views of the sixth exemplary sanitary wipe. The sanitary wipe 500 is substantially triangle shaped, having a pull tab layer 502 with a height D and a center opening, a clear film 504 beneath the center opening of the pull tab layer and having a pad 512 thereunder (see FIG. 8C), an adhesive layer 506 with a center opening beneath the clear film, and an adhesive backing 508 beneath the adhesive layer. One side of the adhesive layer 506 secures the clear film layer 504 to the pull tab layer 502, and an opposite side of the adhesive layer 506 is secured to the containment vessel surface (not shown) after removal of the adhesive backing 508. A breaking point 510 is provided at the detents on opposite sides of the pull tab layer for single-hand operation. In use, the breaking point 510 provides a point where the pull tab layer bends or flips back during removal from a containment vessel surface while the pad stays secure, thereby exposing the pad 512 beneath the clear film 504 for easy removal. The pull tab layer 502, clear film layer 504 and adhesive layer 506 simply bend or flip back during removal from a containment vessel surface, thereby exposing the pad 512 beneath the clear film 504 for easy removal and use.

In one embodiment shown in FIG. 16, the height D is between 1.25 and 1.50 inches, and preferably 1.375 inches, but embodiments are not limited thereto.

FIG. 18 is an exploded enlarged view of the fifth exemplary sanitary wipe of FIG. 8B in accordance with an embodiment of the present invention. As noted above, the sanitary wipe 400 includes the pull tab layer 402 with a center opening, a clear film 404 beneath the center opening of the pull tab layer and having a pad 412 thereunder (see FIG. 8B), an adhesive layer 406 with a center opening beneath the clear film, and an adhesive backing 408 beneath the adhesive layer. One side of the adhesive layer 406 secures the clear film layer 404 to the pull tab layer 402, and an opposite side of the adhesive layer 406 is secured to the containment vessel surface (not shown) after removal of the adhesive backing 408. The pad (not shown) can simply be captured and held in place beneath the clear film layer 404 against the containment vessel surface. The breaking point 410 is provided at the detents on opposite sides of the pull tab layer for single-hand operation. The pull tab layer, or other layers, can be provided with instructions, such as "Pull", "Flip" or "Bend", configured in any symbol or language suitable for the application.

FIG. 19 is an operational view of the fourth exemplary sanitary wipe of FIG. 8A in accordance with an embodiment of the present invention. In each of embodiments 300, 400, 500, the "breaking point", 310, 410, 510 is provided on at least the pull tab layers 302, 402, 502 for single-hand operation. In some embodiments, the breaking point is also provided on the adhesive layer 306, 406, 506. In use, the breaking point provides a point where the embodiment, especially the pull tab layers 302, 402, 502, clear film layers 304, 404, 504, and adhesive layers 306, 406, 506 bend or flip back during removal from a container while the pad stays secure, thereby exposing the pad beneath the clear film for easy removal and use.

For example, in an exemplary application of the present invention, the adhesive backing layer 308 is first removed, and the adhesive layer and remaining layers thereon are attached to a containment vessel (not shown). This can be done at the time and place of manufacture of the containment vessel, or at any time thereafter. Then, as shown in FIG. 19, as the pull tab layer 302 is pulled, the pull tab layer 302, clear film 304 and adhesive layer 306 break, bend or flip back, at the breaking point 310 to expose the pad 312 beneath the clear film 304. The pad 312 can then be pulled from beneath the pull tab layer 302 and the clear film 304, leaving the pull tab layer 302 and the clear film 304 attached to the container. The pad 312 can then be used. In an exemplary embodiment, the breaking points 310, 410, 510 are formed as detents of the pull tab layers, extending inward into the center opening of each and can be etched to permit targeted bending at a center point as shown in FIG. 19.

Although only a few exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A single sanitary wipe attachable to a containment vessel, comprising:
- a planar body, having a top surface, a bottom surface, and an adhesive layer band disposed continuously around a perimeter of the bottom surface only, a width of the adhesive layer band extending between an outermost edge of the planar body and an adhesive free center of the bottom surface of the planar body, and being configured to secure the planar body to the containment vessel;
- a single pad smaller than the planar body, removably positioned at the adhesive free center on the bottom surface of the planar body; and
- a pad cover larger than the single pad and smaller than the planar body, positioned between the single pad and the containment vessel,
- wherein the adhesive layer band is further configured to:
  - secure the pad cover to the bottom surface of the planar body,
  - provide a space to releasably contain only the single pad between the pad cover and the planar body, when the pad cover is secured to the bottom surface of the planar body, and
  - secure the single pad and pad cover, between the bottom surface of the planar body and the containment vessel when the planar body is secured to the containment vessel.

2. The single sanitary wipe of claim 1, wherein the single pad comprises a biodegradable absorbent material, and a sanitizing substance disposed therein.

3. The single sanitary wipe of claim 1, wherein the planar body comprises a waterproof, biodegradable film.

4. The single sanitary wipe of claim 1, wherein the planar body is flexible.

5. The single sanitary wipe of claim 1, wherein the top surface of the planar body is configured to identify at least one of the single pad, a content of the containment vessel, or a temperature of the content of the containment vessel.

6. The single sanitary wipe of claim 1, wherein a shape of the sanitary wipe is configured to identify at least one of the single pad, a content of the containment vessel, or a temperature of the content of the containment vessel.

7. A method of providing a single sanitary wipe attachable to a containment vessel, the method comprising:
- positioning a pad cover, between a single pad and the containment vessel; removably
- positioning the single pad at a center on a bottom surface of a planar body, wherein the single pad and pad cover are smaller than the planar body, and wherein the single pad is smaller than the pad cover; and
- securing the planar body, having a top surface, the bottom surface, and an adhesive layer band disposed continuously around a perimeter of the bottom surface only, a width of the adhesive layer band extending between an outermost edge of the planar body and an adhesive free center of the bottom surface of the planar body, to the containment vessel, wherein the adhesive layer band is configured to:

secure the pad cover to the bottom surface of the planar body, provide a space to releasably contain only the single pad between the pad cover and the planar body, when the pad cover is secured to the bottom surface of the planar body, and secure the single pad and pad cover, between the bottom surface of the planar body and the containment vessel when the planar body is secured to the containment vessel.

8. The method of providing a single sanitary wipe of claim 7, wherein the single pad comprises a biodegradable absorbent material, and a sanitizing substance disposed therein.

9. The method of providing a single sanitary wipe of claim 7, wherein the planar body comprises a waterproof, biodegradable film.

10. The method of providing a single sanitary wipe of claim 7, wherein the planar body is flexible.

11. The method of providing a single sanitary wipe of claim 7, wherein the top surface of the planar body is configured to identify at least one of the single pad, a content of the containment vessel, or a temperature of the content of the containment vessel.

12. The method of providing a single sanitary wipe of claim 7, wherein a shape of the sanitary wipe is configured to identify at least one of the single pad, a content of the containment vessel, or a temperature of the content of the containment vessel.

13. A method of using a single sanitary wipe attachable to a containment vessel, the method comprising:

gripping a portion of a planar body, having a top surface, a bottom surface, and an adhesive layer band disposed continuously around a perimeter of the bottom surface only, a width of the adhesive layer band extending between an outermost edge of the planar body and an adhesive free center of the bottom surface of the planar body, and being configured to secure the planar body to the containment vessel;

pulling the planar body away from the containment vessel and a pad cover, to expose a single pad smaller than the planar body, removably positioned at the adhesive free center on the bottom surface of the planar body, wherein the pad cover is larger than the single pad and smaller than the planar body, and is positioned between the single pad and the containment vessel; and pulling the exposed single pad from the adhesive free center on the bottom surface of the planar body and cleaning a portion of the containment vessel with the single pad, wherein the adhesive layer band is further configured to:

secure the pad cover to the bottom surface of the planar body, provide a space to releasably contain only the single pad between the pad cover and the planar body, when the pad cover is secured to the bottom surface of the planar body, and secure the single pad and pad cover, between the bottom surface of the planar body and the containment vessel when the planar body is secured to the containment vessel.

14. The method of using a single sanitary wipe of claim 13, wherein the single pad comprises a biodegradable absorbent material, and a sanitizing substance disposed therein.

15. The method of using a single sanitary wipe of claim 13, wherein the planar body comprises a waterproof, biodegradable film.

16. The method of using a single sanitary wipe of claim 13, wherein the planar body is flexible.

17. The method of using a single sanitary wipe of claim 13, wherein the top surface of the planar body is configured to identify at least one of the single pad, a content of the containment vessel, or a temperature of the content of the containment vessel.

18. The method of using a single sanitary wipe of claim 13, wherein a shape of the sanitary wipe is configured to identify at least one of the single pad, a content of the containment vessel, or a temperature of the content of the containment vessel.

* * * * *